US012419378B2

(12) United States Patent
Hamburger

(10) Patent No.: US 12,419,378 B2
(45) Date of Patent: Sep. 23, 2025

(54) ROLLABLE SANDAL SHOE

(71) Applicant: Esther Hamburger, Diemen (NL)

(72) Inventor: Esther Hamburger, Diemen (NL)

( * ) Notice: Subject to any disclaimer, the term of this patent is extended or adjusted under 35 U.S.C. 154(b) by 0 days.

(21) Appl. No.: 18/789,299

(22) Filed: Jul. 30, 2024

(65) Prior Publication Data

US 2025/0040652 A1 Feb. 6, 2025

(30) Foreign Application Priority Data

Jul. 31, 2023 (NL) ..... 2035510

(51) Int. Cl.
*A43B 3/24* (2006.01)
*A43B 3/10* (2006.01)

(52) U.S. Cl.
CPC ..... *A43B 3/246* (2013.01); *A43B 3/108* (2013.01); *A43B 3/248* (2013.01)

(58) Field of Classification Search
CPC ..... A43B 3/244; A43B 3/246; A43B 3/248; A43B 3/102; A43B 3/108
See application file for complete search history.

(56) References Cited

U.S. PATENT DOCUMENTS 3,323,233 A * 6/1967 Scholl ..... A43B 3/128 36/11.5
8,813,386 B2 * 8/2014 Pucci ..... A43B 3/248 36/11.5
10,271,609 B2 * 4/2019 Fersaci ..... A43B 11/00
2004/0216329 A1 * 11/2004 Evans ..... A43B 3/106 36/11.5
2007/0204483 A1 * 9/2007 Kirsch ..... A43B 3/24 36/102
2007/0220777 A1 * 9/2007 Richardson ..... A43B 3/248 36/11.5
2014/0230286 A1 * 8/2014 Paugh ..... A43B 1/0063 36/25 R (Continued)

FOREIGN PATENT DOCUMENTS

DE 102009023689 A1 12/2010
DE 202014100294 U1 * 6/2015 ..... A43B 3/105

(Continued)

OTHER PUBLICATIONS

English Translation of DE 202014100294; 6 pages (Year: 2015).*

(Continued)

*Primary Examiner* — Ted Kavanaugh
(74) *Attorney, Agent, or Firm* — Thomas P. O'Connell; O'Connell Law Office

(57) ABSTRACT

A sandal shoe comprising a flexible sole on the underside and a footbed on the upper side and releasable material, wherein the sole and the footbed comprise an elongate object of rollable bistable material, and a means for connecting releasable material to the sole and the footbed. Two embodiments thereof are described: the sole (2) and the footbed (3) enclose the rollable bistable material (4) or the footbed itself is the rollable bistable material. The means comprises for instance an attachment suitable for passage of releasable material, provided on the rear side of the footbed. An application for transporting the sandal shoe is further described wherein the sandal shoe is transported while rolled up, for instance in a bag or on an arm.

9 Claims, 3 Drawing Sheets

(56) References Cited

U.S. PATENT DOCUMENTS

2022/0378143 A1* 12/2022 Reichard ..... A43B 3/102

FOREIGN PATENT DOCUMENTS

| | | | |
|---|---|---|---|
| KR | 20160017984 | A | 2/2016 |
| WO | WO2012081774 | A1 | 6/2012 |
| WO | WO2013166279 | A2 | 11/2013 |

OTHER PUBLICATIONS

European Patent Office, International Search Report and Written Opinion, Feb. 8, 2024, 6 pages, European Patent Office, Rijswijk, the Netherlands.

* cited by examiner

ROLLABLE SANDAL SHOE

RELATED APPLICATION

This application claims priority to Netherlands Patent Application No. 2035510, filed Jul. 31, 2023.

FIELD OF THE INVENTION

The invention relates to a sandal shoe comprising a flexible sole on the underside and a footbed on the upper side and releasable material.

BACKGROUND OF THE INVENTION

People generally wear footwear to protect their feet against hazards, heat and sharp objects while walking. Sandals are a type of footwear, generally a style of footwear associated with an informal and relaxed environment. This style of footwear is further convenient to carry along for scenarios such as a trip to the beach, where the sandals are preferably transported during the journey, such as for instance wrapped up, and are generally worn at the destination.

In order to enable more convenient transport of sandals foldable sandals are described in several patent documents, with a hinge in transverse direction in US patent documents 20220264988 and 2011016748, while a hinge in longitudinal direction is also described in U.S. Pat. No. 7,694,435. Hinges have the drawback that they form an unevenness in the footbed, which can be unpleasant when walking.

SUMMARY OF THE INVENTION

The object of the invention is to design a sandal shoe which can be transported efficiently when not being worn on the foot. It is additionally important that the sandal shoe be comfortable and that it can be produced as efficiently and inexpensively as possible.

The present invention has for its object to provide a sandal shoe of the type stated in the preamble, namely comprising a sandal shoe body with a flexible sole on the underside and a footbed on the upper side and releasable material, wherein the sole and the footbed comprise an elongate object of rollable bistable material, and a means for connecting releasable material to the sandal shoe. In a preferred embodiment the sole and the footbed enclose the elongate object of rollable bistable material and are mutually attached therearound. The sole and the footbed are preferably sewn together around the object of bistable material, for instance using backstitches of wear-resistant and water-resistant yarns, such as polyester-based yarns. In addition, sole and footbed are preferably attached to each other, such as glued to each other, at least partially adjacently of the bistable material. Water-resistant adhesives such as for instance 3M Scotch-Weld 1099 are particularly used for this purpose.

The footbed of this embodiment of the sandal shoe according to the invention is preferably made of thin and soft material, more preferably of soft rubber such as for instance foam rubber, of leather or of felt. The dimensions of the elongate object of rollable bistable material will generally be such that the distance to the edge of the sandal is about 0.3-4 cm, preferably about 0.5-3 cm, everywhere.

In another embodiment of the sandal shoe according to the invention the footbed itself is the object of rollable bistable material.

The object of rollable bistable material in the sandal shoe according to the invention is particularly made of flexible stainless metal, such as for instance steel. More preferably, a slap bracelet is applied as object of rollable bistable material.

The means is preferably an attachment suitable for passage of releasable material, provided on the rear side of the footbed. In another embodiment, the means for connecting the releasable material to the sandal shoe body comprises holes suitable for passage of releasable material in order to connect this material to the sole and the footbed, preferably 3-6 holes in the sole and the footbed, wherein both the sole and the footbed usually comprise the same number of holes. The sandal shoe according to the invention can also comprise both means for passage of releasable material.

The releasable material particularly comprises ribbon, lace or cord, preferably made of leather, such as cow leather, cotton, polyester, elastic, rope, or a metallic ribbon, which fits through the passage of the attachment and/or through the holes. An elastic cord consists of for instance 55% polyamide, 25% lurex and 20% polyester. The ribbon generally also serves to enable the sandal to be fastened, for instance crosswise, to the leg adjacently of the foot. Exchanging ribbons can particularly take place easily when use is made of an attachment.

The sandal shoe more preferably comprises a sole of thin and wear-resistant material, preferably of soft rubber such as for instance foam rubber or leather, particularly polyurethane leather with anti-slip pattern.

A particularly advantageous aspect of the invention is formed by an application for transporting the sandal shoe according to the invention, wherein the sandal shoe is transported while rolled up, for instance in a bag or on an arm.

In this patent document the term sandal is also understood to mean sandal shoe, and vice versa. Bistable material is material with two stable states. It is possible to envisage rolled spring steel here. The term holes refers to a means intended to connect releasable material to the sandal shoe, stitching holes to the holes intended for yarn for sewing sole and footbed together.

What is exceptional about the sandal shoe according to the invention is the option of carrying it along while rolled up, in a bag or optionally slapped around a suitable body part such as the arm, before or after being worn on the feet. It is sometimes only necessary to wear sandals for a short period of time, for instance when crossing hot sand or to be able to walk comfortably before or after wearing formal shoes. It is then highly convenient if rolled-up sandals do not take up a great deal of space in a bag, particularly a purse, or if they can optionally be transported on an arm.

A sandal according to the invention is hardly any more expensive than a known flip-flop provided with ribbon or lace which is generally tied around the leg adjacently of the foot in net-like manner. An object of bistable material, such as for instance in the form of a slap bracelet, can be added to such a sandal between sole and footbed in efficient and inexpensive manner. CN utility model 201349579 describes a rollable sandal with toe straps, wherein these straps are connected to the shoe edge which has the ability to roll. The drawback hereof is that the toe straps must be made of stronger material than laces or ribbon which is also tied around the leg when worn, whereby the sandal according to the invention is smaller in rolled-up state than that described in CN 21034795. The edge with ability to roll described here is moreover more difficult to produce than the sandal according to the invention with an object of rollable bistable material between sole and footbed or the footbed itself of rollable material.

BRIEF DESCRIPTION OF THE DRAWINGS

Other characteristics and advantages of the rollable sandal shoe disclosed herein will become apparent on reading the detailed description that follows with further reference to the accompanying drawings wherein like numbers are used to indicate like components and wherein.

DETAILED DESCRIPTION OF PREFERRED EMBODIMENTS

The present invention is further elucidated on the basis of the following drawings of an embodiment of the sandal shoe according to the invention with an object of rollable bistable material between sole and footbed. The figures are schematic and not drawn to scale.

Figure 1:
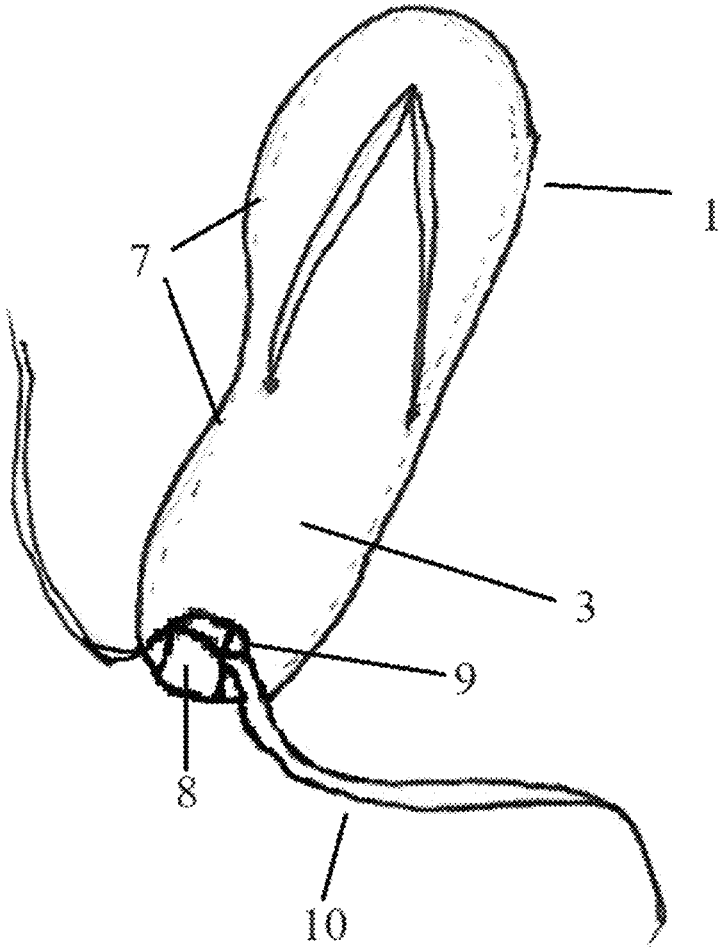
FIG. 1 is a top plan view of the sandal shoe disclosed herein.

FIG. 1 shows the upper side of the sandal shoe (1), wherein the footbed (3) is connected to the sole using yarn, such as through the stitching holes (7), and an attachment (8) provided with a passage (9) for cord (10).

Figure 2:
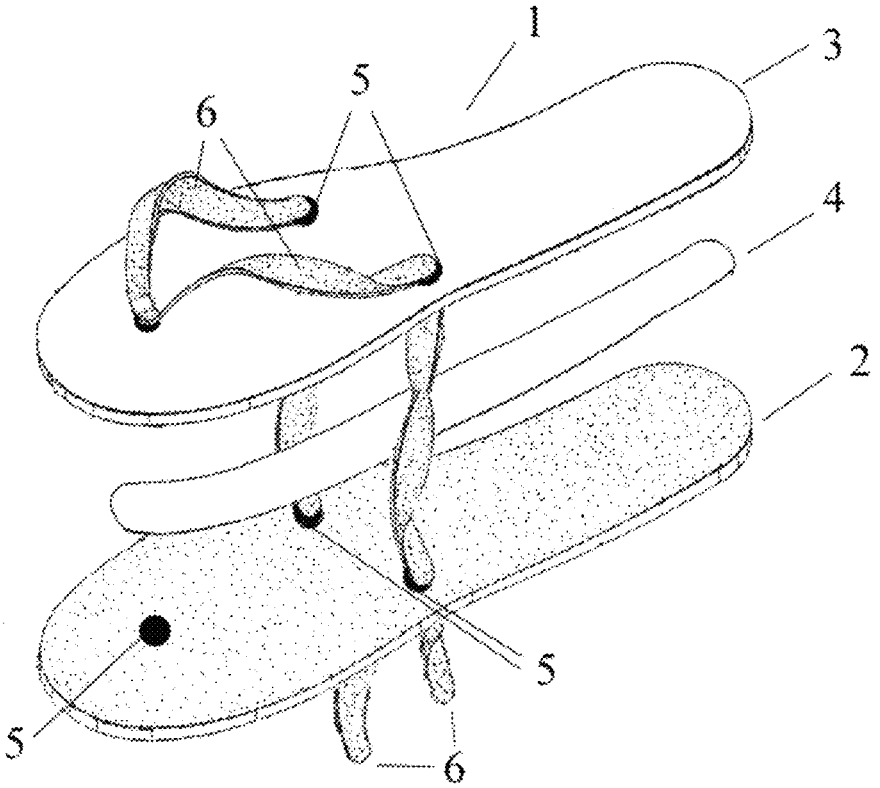
FIG. 2 is a partially exploded perspective view of the sandal shoe of FIG. 1.

FIG. 2 is a cut-away view of sandal shoe (1) comprising a flexible sole (2) on the underside and a flexible footbed (3) on the upper side, wherein the sole and the footbed enclose rollable bistable material (4) and holes (5) for connecting ribbon (6) to the sole and the footbed. The flexible sole (2) and the flexible footbed (3) may be considered to form a sandal shoe body. Since the figure provides a cut-away image it is not shown that sole and footbed are attached to each other around the bistable material.

Figure 3:
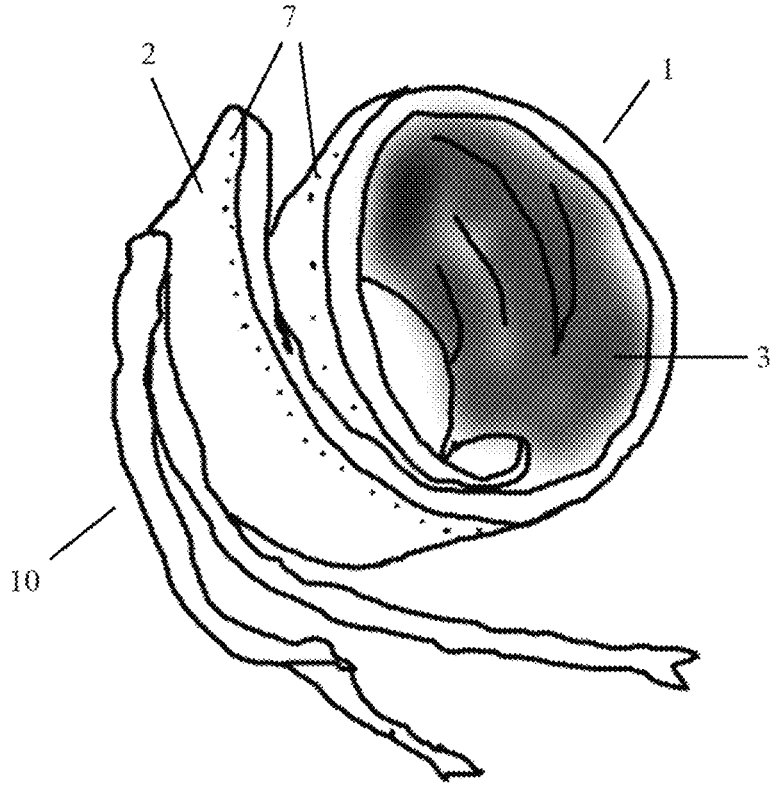
FIG. 3 is a perspective view of the sandal shoe of FIG. 1 in a rolled configuration.

FIG. 3 is a view of the sandal (1) in rolled-up form with sole (2) on the outer side and footbed (3) on the inner side, stitching holes (7) and cord (10).

The attachment (8) is connected to the footbed (3) and can for instance be sewn thereto. The cord or ribbon (10) and the like generally also serve to enable the sandal (1) to be fastened, for instance crosswise, to the leg adjacently of the foot.

This ribbon or cord (10) and the like, which can be referred to as a releasable material, can be easily exchanged and thereby have different colours, this fulfilling the common desire for footwear to match clothing of various colours. The most exceptional thing about this invention however is that this sandal (1) can be made small and can thereby be transported easily in this way when it is not being worn on the foot.

Although the invention has been elucidated above with reference to two embodiments and their application, it will be apparent that the invention is by no means limited thereto. On the contrary, many variations are still possible within the scope of the invention for a person with ordinary skill in the art. It will be clear that those with major features of the invention in mind could craft embodiments that incorporate those major features while not incorporating all of the features included in the preferred embodiments.

Therefore, the following claims shall define the scope of protection to be afforded to the invention. Those claims shall be deemed to include equivalent constructions insofar as they do not depart from the spirit and scope of the invention. It must be further noted that a plurality of the following claims may express, or be interpreted to express, certain elements as means for performing a specific function, at times without the recital of structure or material. As the law demands, any such claims shall be construed to cover not only the corresponding structure and material expressly described in this specification but also all legally-cognizable equivalents thereof.

The following is claimed as deserving the protection of Letters Patent:

1. A sandal shoe with an underside and an upper side, the sandal shoe comprising a sandal shoe body with a flexible sole on the underside and a footbed on the upper side, a releasable material connected to the sandal shoe body, and an elongate object of rollable bistable material comprising a slap bracelet, wherein the flexible sole and the footbed enclose the elongate object of rollable bistable material and wherein the flexible sole and the footbed are mutually attached around the elongate object of rollable bistable material whereby the sandal shoe can be optionally slapped around a body part before or after being worn on a foot.

2. The sandal shoe of claim 1, wherein the sole and footbed are sewn together around the object of rollable bistable material.

3. The sandal shoe of claim 1, wherein the footbed is made of thin and soft material comprising soft rubber, leather, or felt.

4. The sandal shoe of claim 1, wherein the object of rollable bistable material is made of flexible stainless metal.

5. The sandal shoe of claim 1, wherein the releasable material is connected to the sandal shoe body by an attachment suitable for passage of the releasable material provided on a rear portion of the footbed.

6. The sandal shoe of claim 5, wherein the releasable material is connected to the sandal shoe body by holes suitable for passage of the releasable material in the sole and the footbed.

7. The sandal shoe of claim 6, wherein the releasable material comprises ribbon, lace or cord comprising cotton, polyester, elastic, rope, or a metallic ribbon adapted to fit through the holes.

8. The sandal shoe of claim 7, wherein the sole is made of thin and wear-resistant material and comprises soft rubber or leather.

9. A method for transporting the sandal shoe of claim 1, wherein the sandal shoe is transported while rolled up.

* * * * *